US006598513B2

(12) United States Patent
Yabe

(10) Patent No.: US 6,598,513 B2
(45) Date of Patent: Jul. 29, 2003

(54) CYLINDER APPARATUS

(75) Inventor: Toshiharu Yabe, Kitasoma-gun (JP)

(73) Assignee: SMC Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/006,355

(22) Filed: Dec. 10, 2001

(65) Prior Publication Data

US 2002/0069680 A1 Jun. 13, 2002

(30) Foreign Application Priority Data

Dec. 11, 2000 (JP) ..... 2000-376544

(51) Int. Cl.[7] ..... F15B 13/04
(52) U.S. Cl. ..... 92/404; 92/27
(58) Field of Search ..... 92/24, 27, 28, 92/85 A

(56) References Cited

U.S. PATENT DOCUMENTS 2,130,618 A * 9/1938 Gnavi ..... 92/27
3,033,171 A * 5/1962 Engelbrecht et al. ..... 92/27
3,889,576 A * 6/1975 Sheffer et al. ..... 92/24
5,365,828 A * 11/1994 Sperber et al. ..... 92/28
5,406,879 A * 4/1995 Willacy ..... 92/24

FOREIGN PATENT DOCUMENTS

JP 2001-248610 9/2001

* cited by examiner

*Primary Examiner*—Edward K. Look
*Assistant Examiner*—Igor Kershteyn
(74) *Attorney, Agent, or Firm*—Paul A. Guss

(57) ABSTRACT

A cylinder apparatus comprises a cylinder tube which is connected between a first cover member and a second cover member each having a cylindrical configuration, an axially displaceable piston which inscribes the cylinder tube, a piston rod which is connected to the piston, an intermediate member which is connected between the cylinder tube and the second cover member, an axially movable member which inscribes the intermediate member, a first spring member which is connected between the second cover member and the movable member, and a piston pin mechanism which is inserted into a recess of the piston rod in a direction perpendicular to the axis.

6 Claims, 13 Drawing Sheets

PRIOR ART

PRIOR ART

PRIOR ART

PRIOR ART

PRIOR ART

CYLINDER APPARATUS

BACKGROUND OF THE INVENTION

1. Field of the Invention

The present invention relates to a cylinder apparatus which can be used to open and close a key by converting fluid energy supplied from a pressure fluid supply source into mechanical energy, transmitting driving force to a key through a link section disposed at a forward end of a piston rod, and inserting the key into a key groove of a workpiece.

2. Description of the Related Art

As shown in FIG. 11, a cylinder apparatus 1 has been conventionally used which includes the following mechanism as a driving source. That is, a piston 5 accommodated in a cylinder tube 4 connected between a head cover 2 and a rod cover 3 is displaced to a displacement terminal end by compressed air supplied from a pressure fluid port 20, 21. A first spring 9 installed between a pair of holding members 8*a*, 8*b* then contracts. Thereafter, the first spring 9 expands to press and return the piston 5. The piston 5 is displaced to an arbitrary position in the direction of the initial position.

If a workpiece is formed of resin, a key cannot be inserted into a key groove of the workpiece at an originally set position of the key due to an error of dimensional accuracy.

According to the conventional cylinder apparatus 1, therefore, the key position is previously determined in consideration of the error of the dimensional accuracy of the workpiece at the displacement terminal end of the piston 5. The key fits an originally set position of the key groove of the workpiece if the piston 5 is pressed and returned from the previously determined position by the expanding force of the first spring 9.

As shown in FIG. 11, the piston 5 of the conventional cylinder apparatus 1 is displaced if the piston 5 is pressed and returned by the expanding force of the first spring 9. When a pin 16 of a piston pin mechanism 15 is inserted into a recess 7 of a piston rod 6 under the action of a second spring 18, the pin 16 contacts the recess 7 of the piston rod 6 pressed and returned by the first spring 9. Thus, the pin 16 and the recess 7 are fastened to one another to set a displacement amount of the piston 5 in the direction of the initial position.

However, it is impossible for the cylinder apparatus 1 thus constructed to unlock the pin 16 easily and conveniently due to contact resistance between the side surface of the recess 7 of the piston rod 6 and the side surface of the pin 16.

According to the conventional cylinder apparatus 1, further, a first three-port solenoid-operated valve 22*a* is energized at the initial position shown in FIG. 12 and a second three-port solenoid-operated valve 22*b* is opened to the atmospheric air. The pressure fluid is supplied from a fluid supply source 23 into the cylinder apparatus 1 to displace the piston 5 to the displacement terminal end position (see FIG. 13). Further, the piston 5 is slightly displaced in the direction of the initial position with the respective pair of three-port solenoid-operated valves 22*a*, 22*b* being switched to be opened to the atmospheric air (see FIG. 14).

In the above procedure, the pin 16 is inserted into the recess 7 (see FIG. 11) of the piston rod 6 to position the piston 5. As shown in FIG. 15, the two three-port solenoid-operated valves 22*a*, 22*b* need to be provided for simultaneously pressurizing the pressure fluid from the pressure fluid ports 20, 21 so as to release the side surface of the recess 7 of the piston rod 6 and the side surface of the pin 16 from the fastened state thereof. Therefore, the number of components and steps is increased, and the control circuit becomes complicated.

SUMMARY OF THE INVENTION

It is a general object of the present invention to provide a cylinder apparatus which can hold or unlock a piston easily and conveniently even if an error of dimensional accuracy or the like occurs.

A principal object of the present invention is to provide a cylinder apparatus which can insert a key into a key groove of a workpiece easily and conveniently and to unlock a pin from a recess of a piston rod with ease.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
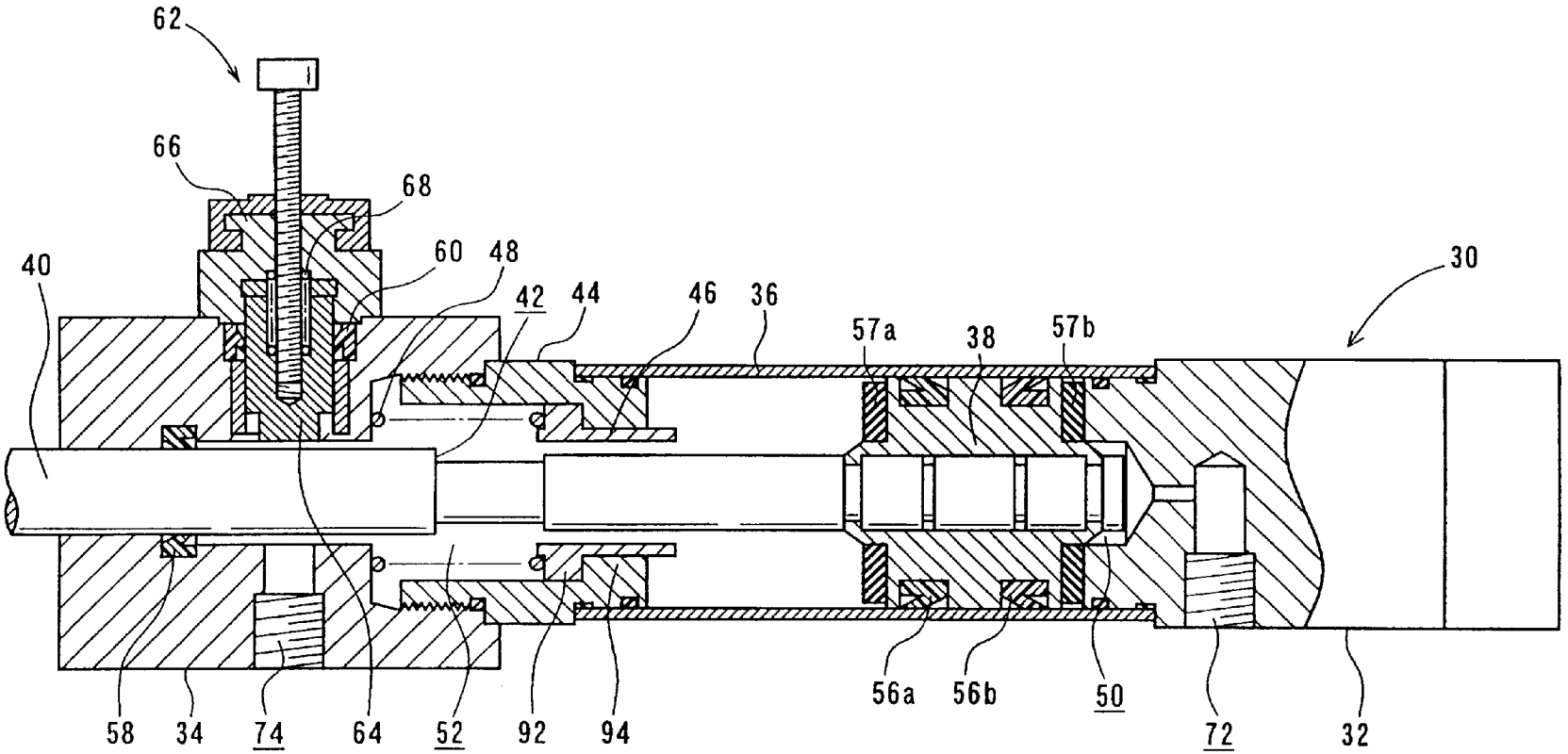
FIG. 1 is a longitudinal sectional view taken along the axial direction at an initial position of a piston of a cylinder apparatus according to an embodiment of the present invention.

A cylinder apparatus 30 according to an embodiment of the present invention is shown in FIG. 1.

Figure 4:
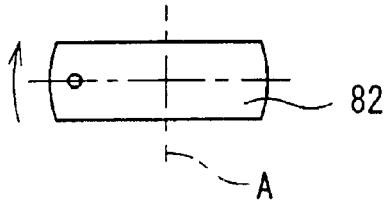
FIG. 4 is a plan view illustrating the operation of a key at the initial position of the piston of the cylinder apparatus according to the embodiment of the present invention.

In the following description, it is assumed that an initial position resides in a state where an end surface of a piston 38 abuts against a first cover member 32 as shown in FIG. 1 and a state where a key 82 is substantially parallel to the axial direction of the cylinder apparatus 30 as shown in FIG. 4.

The cylinder apparatus 30 basically comprises a cylinder tube 36 which is connected integrally between the first cover member 32 and a second cover member 34 each having a cylindrical configuration, the piston 38 which is installed in the cylinder tube 36 and which is axially displaceable in the cylinder tube 36, and a piston rod 40 which is connected to the piston 38.

The first cover member 32 is disposed on the head side of the cylinder tube 36. A first chamber 50 is formed between the first cover member 32 and an end surface of the piston 38 in the cylinder tube 36. The second cover member 34 is disposed on the rod side of the cylinder tube 36. A second chamber 52 is formed between the second cover member 34 and another end surface of the piston 38 in the cylinder tube 36.

A first pressure fluid inlet and outlet port 72 is formed in the outer circumference of the first cover member 32. The first pressure fluid inlet and outlet port 72 is supplied with a pressure fluid supplied from a pressure fluid supply source 90 (see FIGS. 7 to 9) and communicates with the first chamber 50. A second pressure fluid inlet and outlet port 74 is formed in the outer circumference of the second cover member 34. The second pressure fluid inlet and outlet port 74 is also supplied with the pressure fluid supplied from the pressure fluid supply source 90 under the switching action of a five-port solenoid-operated valve 70 (see FIGS. 7 to 9) as described later on. The second pressure fluid inlet and outlet port 74 communicates with the second chamber 52.

The piston 38 has a pair of first packings 56*a*, 56*b* disposed in annular grooves formed in an outer circumferential surface inscribing the cylinder tube 36. The pair of first packings 56*a*, 56*b* are spaced from each other by a predetermined distance. Accordingly, the first chamber 50 and the second chamber 52 are kept hermetical respectively.

Annular buffer members 57*a*, 57*b* are installed to both end surfaces of the piston 38 to mitigate the shock caused if the piston 38 abuts against the first and second cover members 32, 34. The respective annular buffer members 57*a*, 57*b* are composed of an elastic member such as rubber.

Further, the piston 38 is displaceable in the axial direction thereof under the action of the pressure fluid supplied from the first pressure fluid inlet and outlet port 72 and the second pressure fluid inlet and outlet port 74.

A piston rod 40 is connected to the substantial center of the piston 38. An externally exposed end of the piston 40 is supported by the second cover member 34. An annular recess 42 is partially formed in the outer circumferential surface of the piston rod 40.

A second packing 58 is disposed at a portion where the piston rod 40 is supported by the second cover member 34 to keep the second chamber 52 hermetical.

An intermediate member 44 is connected integrally between the cylinder tube 36 and the second cover member 34. The intermediate member 44 stops the piston 38 when the piston 38 is displaced up to the displacement terminal end position. That is, when the piston 38 is displaced in the direction of the second cover member 34, the piston 38 abuts against an end surface of a movable member 46. The piston 38 is displaced while pressing the movable member 46 in the direction of the second cover member 34 against the spring force of a first spring member 48. The piston 38 stops when it abuts against the intermediate member 44.

The movable member 46 of a substantially cylindrical shape is internally fitted to the intermediate member 44. The movable member 46 is displaceable in the axial direction of the piston 38. A third chamber 54 is formed between the intermediate member 44 and the movable member 46 (see FIG. 2). The first spring member 48 is interposed between the second cover member 34 and the movable member 46. The piston 38 can be displaced by the movable member 46 in the direction of the initial position if the piston 38 is pressed and returned at the displacement terminal end position thereof. The movable member 46 is fastened to the first spring member 48.

A first annular projection 92 protruding radially outwardly is formed at the end of the movable member 46. The first annular projection 92 is fastened to a second annular projection 94 at the displacement terminal end position under the action of the spring force of the first spring member 48. The second annular projection 94 is formed at the end of the intermediate member 44 and protruds radially inwardly.

The intermediate member 44 and the movable member 46 may be disposed not only on the first cover member 32 but also on the second cover member 34. They may also be disposed on both of the first cover member 32 and the second cover member 34.

A piston pin mechanism (fastening mechanism) 62 is driven by the pressure fluid. The piston pin mechanism 62 comprises a main body 66 which is disposed on a outer circumference of the second cover member 34, a pin 64 which is disposed in a direction substantially perpendicular to the axis of the piston rod 40, a third packing 60 which is provided at a pin support section of the second cover member 34, and a second spring member 68 which is connected between the pin 64 and the main body 66. The pin 64 is vertically movable by the pressure fluid, the pressure fluid inserting the pin 64 into the recess 42 of the piston rod 40.

When the pressure fluid is supplied, it is introduced into the second chamber 52. The second spring member 68 contracts to press the pin 64 upwardly. The third packing 60 keeps the second chamber 52 hermetical.

When the pressure fluid is not supplied, the second spring member 68 expands to displace the pin 64 downwardly. The pin 64 is inserted into the recess 42 of the piston rod 40.

Figure 10:
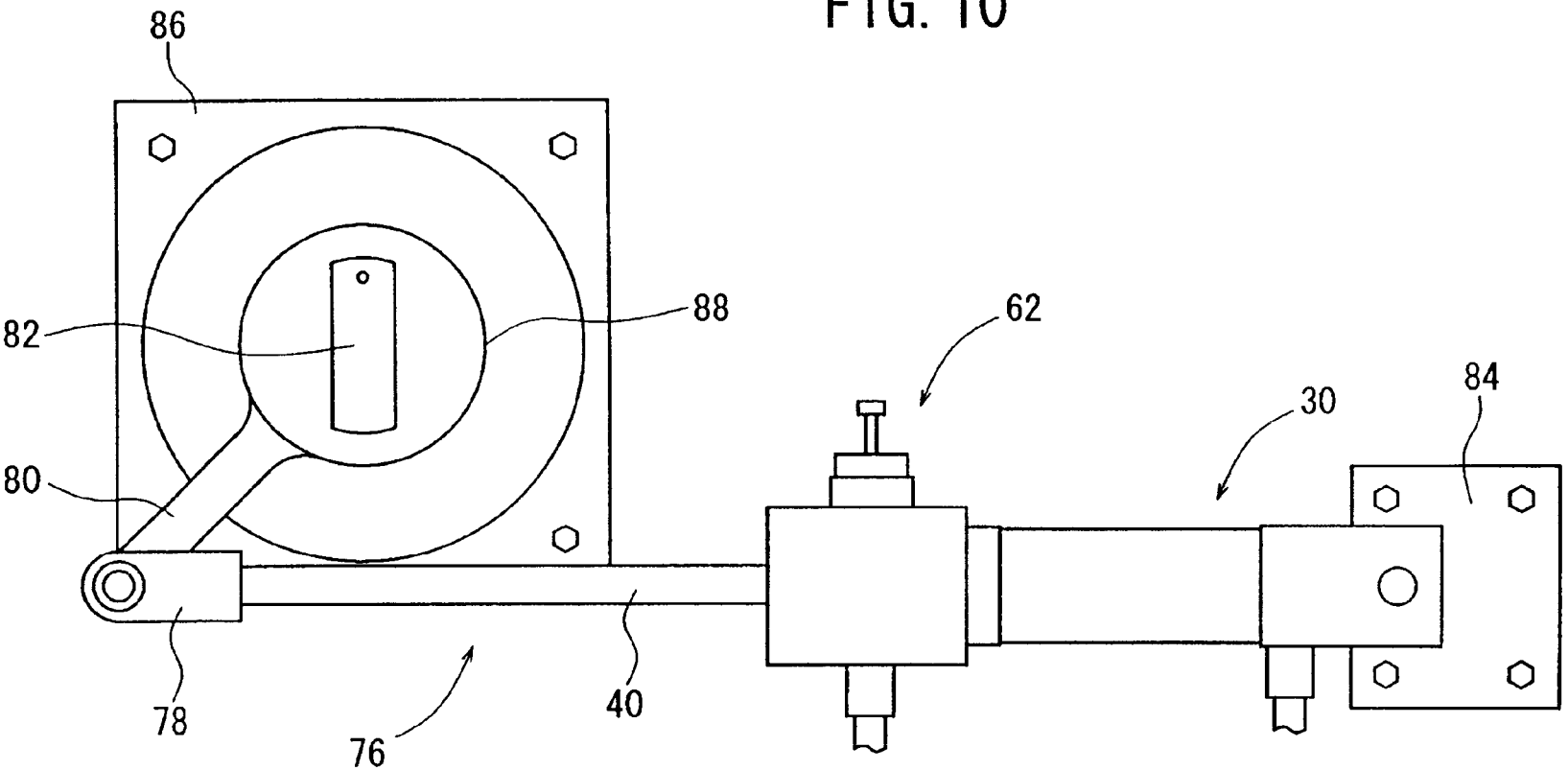
FIG. 10 is a plan view illustrating a driving force-transmitting mechanism incorporated with the cylinder apparatus according to the embodiment of the present invention.
Figure 11:
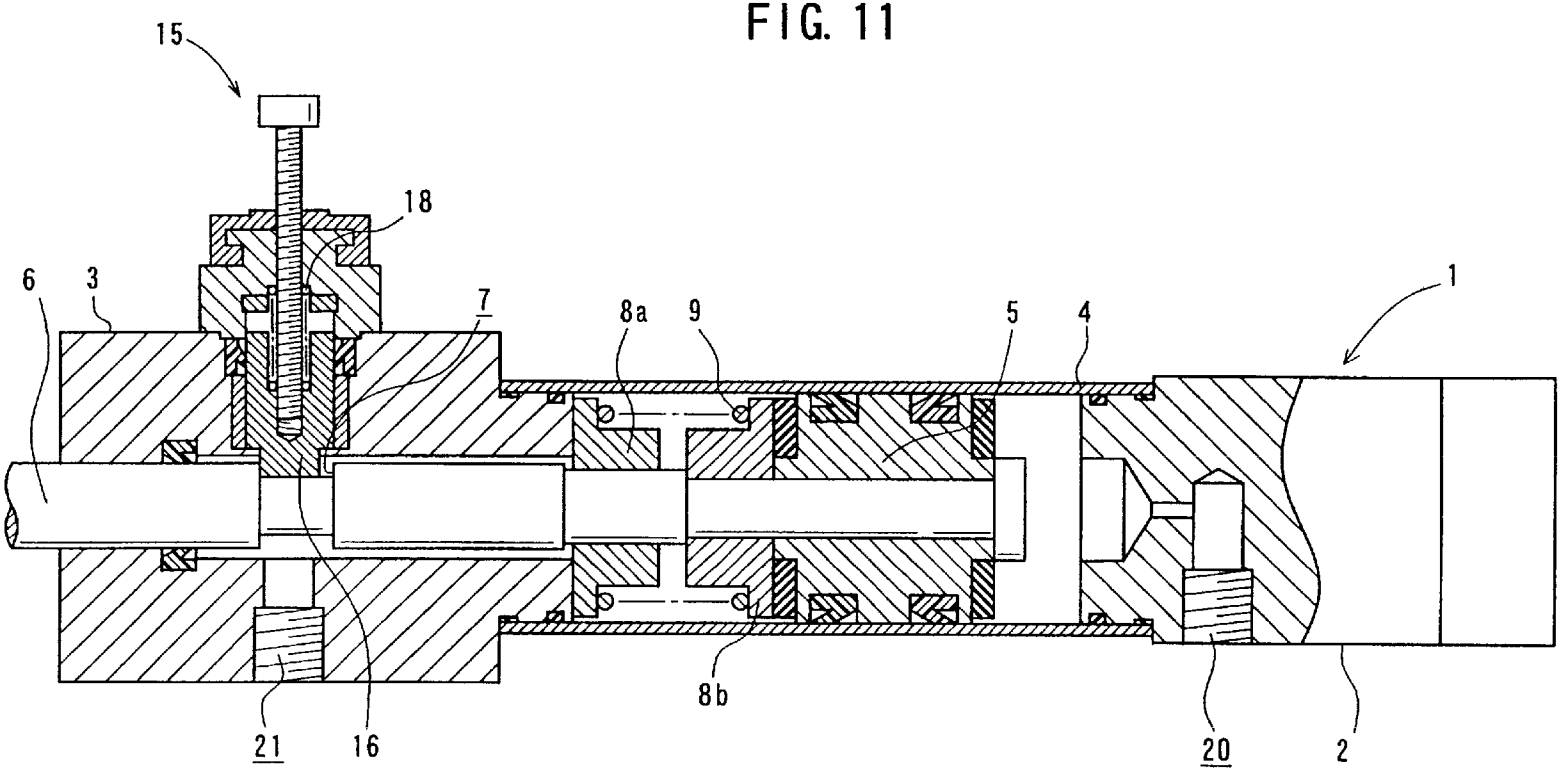
FIG. 11 is a longitudinal sectional view taken along the axial direction at an intermediate position of a piston of a conventional cylinder apparatus.
Figure 12:
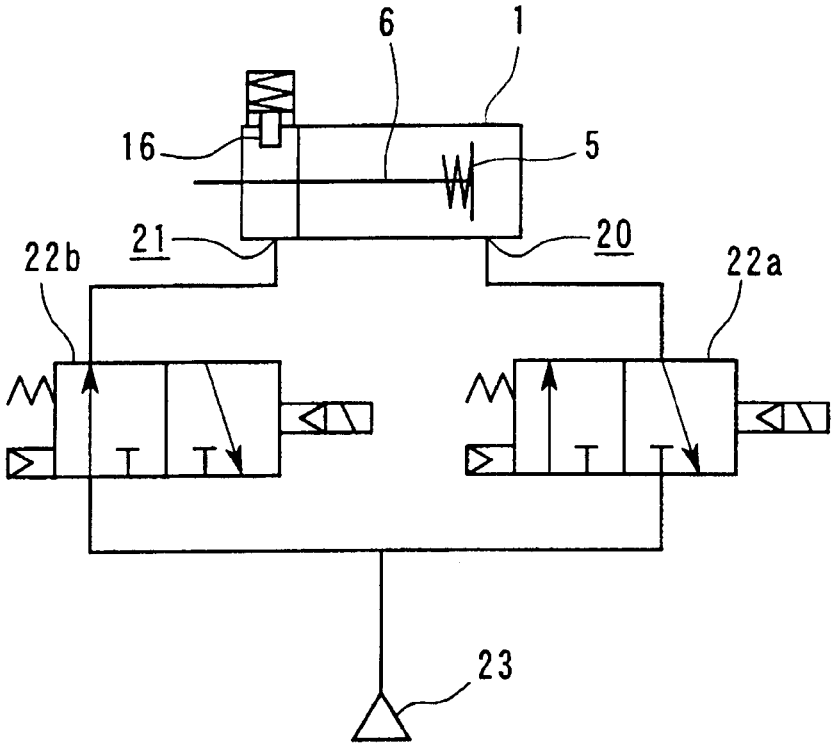
FIG. 12 is a diagram of circuit arrangement illustrating an initial position of the piston of the conventional cylinder apparatus.
Figure 13:
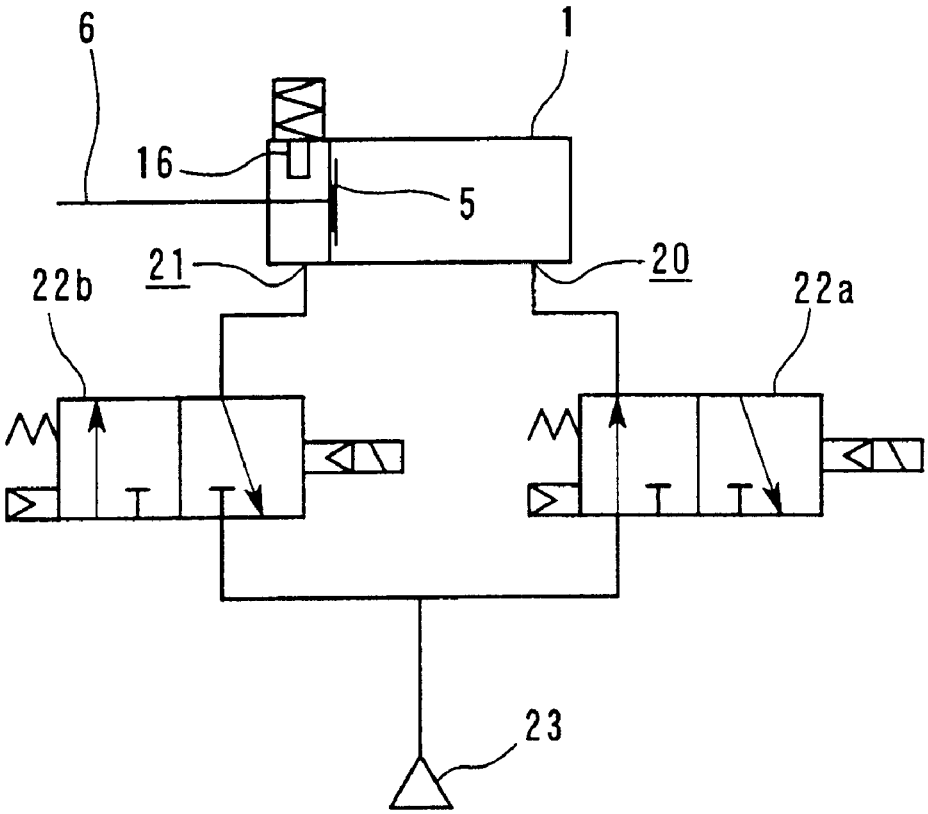
FIG. 13 is a diagram of circuit arrangement illustrating a displacement terminal end position of the piston of the conventional cylinder apparatus.
Figure 14:
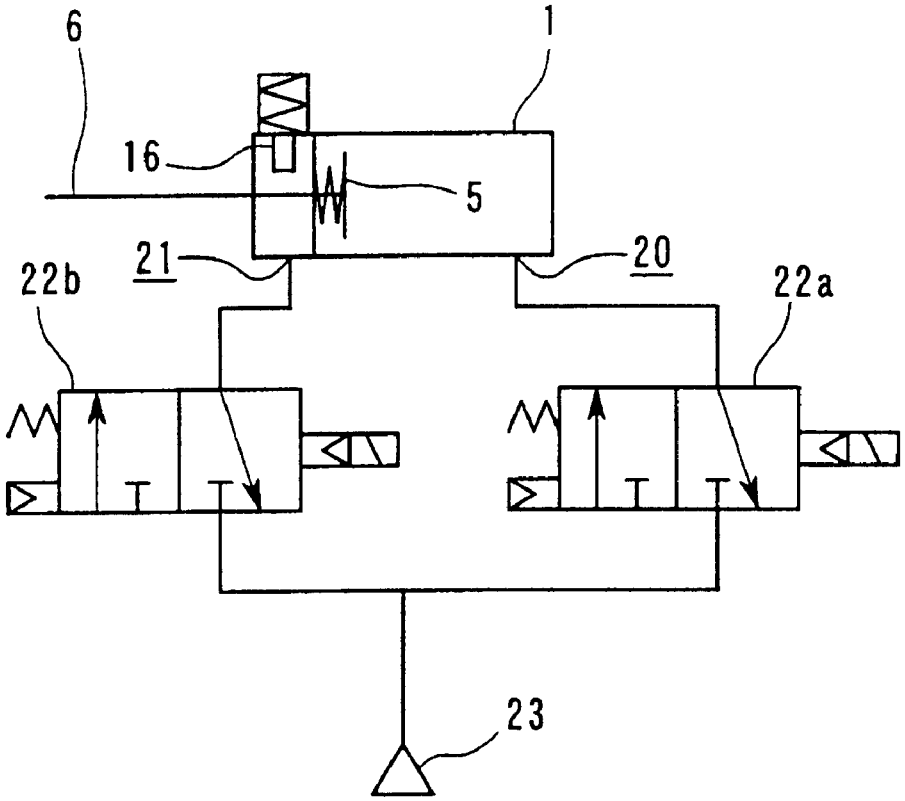
FIG. 14 is a diagram of circuit arrangement illustrating an intermediate position of the piston of the conventional cylinder apparatus.

As shown in FIG. 10, a driving force-transmitting mechanism 76 comprises a knuckle joint (joint member) 78 which is connected to the end of the piston rod 40 and which converts the rectilinear motion of the piston rod 40 into the rotary motion, a rotary member 88 which includes a bearing (not shown) therein and which is rotatable about the axial center of the bearing, a link section 80 which transmits the rotary motion of the knuckle joint 78 to the rotary member 88, and the key 82 of a pillar shape which is formed on the upper surface of the rotary member 88 and which is inserted into a key groove of an unillustrated workpiece. The driving force-transmitting mechanism 76 further comprises a first fixing member 84 which fixes the cylinder apparatus 30 to a structural member (not shown), and a second fixing member 86 which fixes the rotary member 88 to the structural member (not shown).

The cylinder apparatus 30 according to the embodiment of the present invention is basically thus constructed. Its operation, function, and effect will now be explained.

An unillustrated tube is used to connect the first pressure fluid inlet and outlet port 72 and the second pressure fluid inlet and outlet port 74 to the pressure fluid supply source 90 at the initial position.

Figure 8:
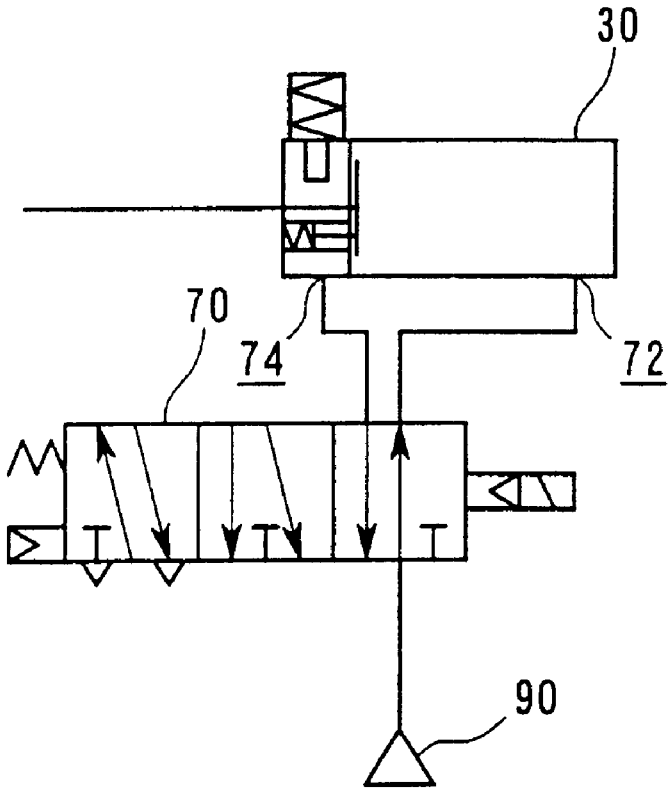
FIG. 8 is a diagram of circuit arrangement illustrating the displacement terminal end position of the piston of the cylinder apparatus according to the present invention.

As shown in FIG. 8, the pressure fluid is supplied from the pressure fluid supply source 90 via the five-port solenoid-operated valve 70 to the first pressure fluid inlet and outlet port 72. Then, the second pressure fluid inlet and outlet port 74 is being communicated with the atmospheric air. The pressure fluid is supplied from the first pressure fluid inlet and outlet port 72 and is introduced into the first chamber 50 in the cylinder tube 36. The piston 38 is pressed in the direction of the second cover member 34, while contracting the first spring member 48 interposed between the second cover member 34 and the movable member 46.

When the piston 38 is pressed toward the second cover member 34, the piston rod 40 connected integrally to the piston 38 is also displaced.

Figure 2:
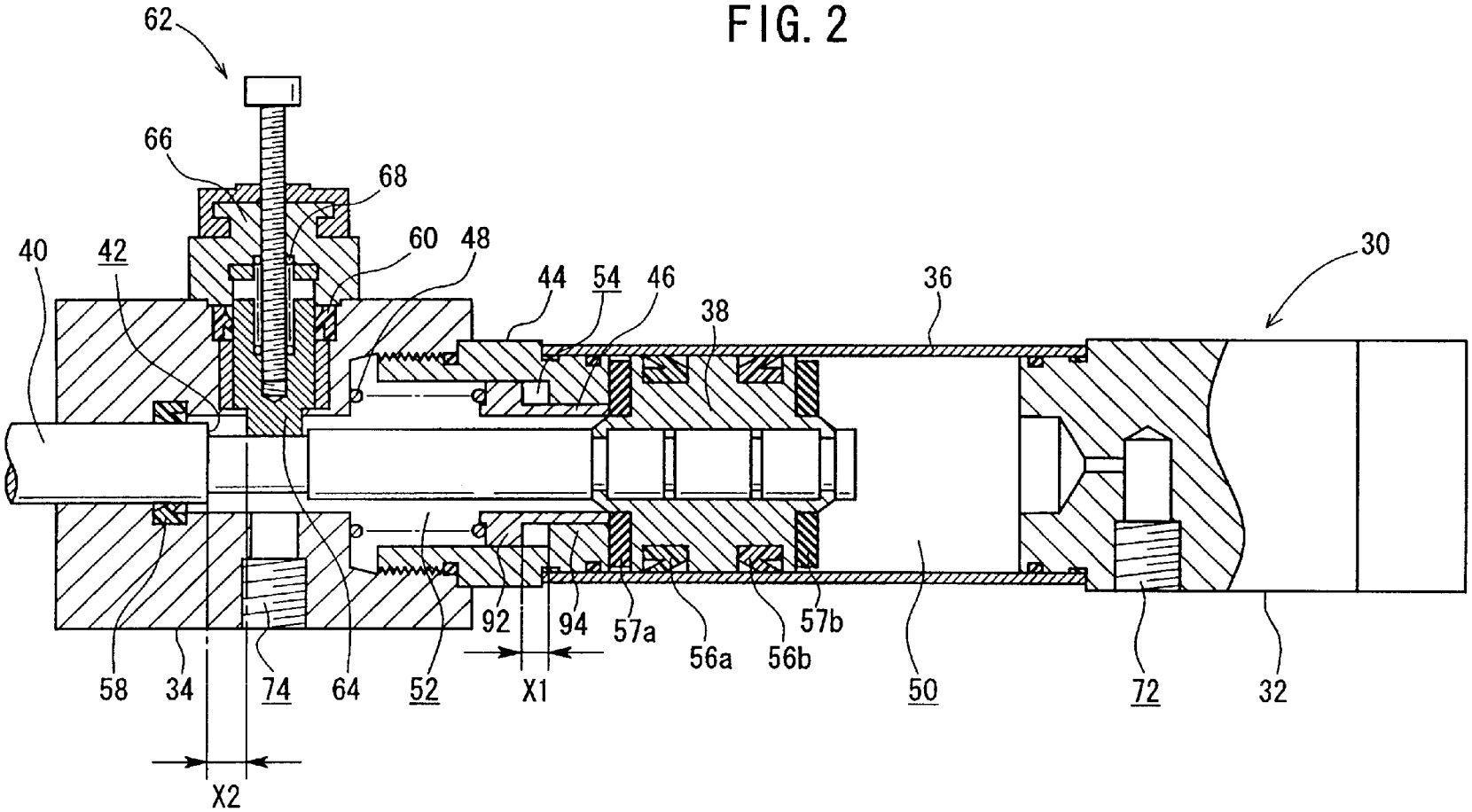
FIG. 2 is a longitudinal sectional view taken along the axial direction at a displacement terminal end position of the piston of the cylinder apparatus according to the embodiment of the present invention.

As shown in FIG. 2, the end surface of the piston 38 abuts against the intermediate member 44 at the displacement terminal end position.

Then, the knuckle joint 78 connected to the end of the piston rod 40 converts the rectilinear motion of the piston rod 40 into the rotary motion. The driving force is transmitted to the link section 80 connected to the knuckle joint 78. The driving force is further transmitted through the link section 80 to the rotary member 88 connected to the other end of the link section 80.

Figure 5:
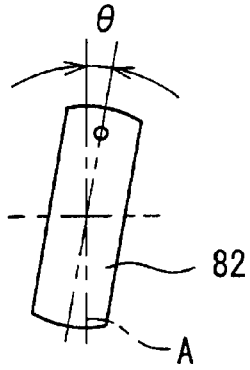
FIG. 5 is a plan view illustrating the operation of the key during a step of unlocking a pin of a piston pin mechanism at the displacement terminal end position of the piston of the cylinder apparatus according to the embodiment of the present invention.

As shown in FIG. 5, the key 82, which is formed on the upper surface of the rotary member 88, is rotated by an angle θ° from the axis A perpendicular to the axis of the cylinder apparatus 30.

As shown in FIG. 2, the pin 64 is pressed by the second spring member 68 at the displacement terminal end position and the forward end of the pin 64 is inserted into the recess 42 of the piston rod 40.

Figure 3:
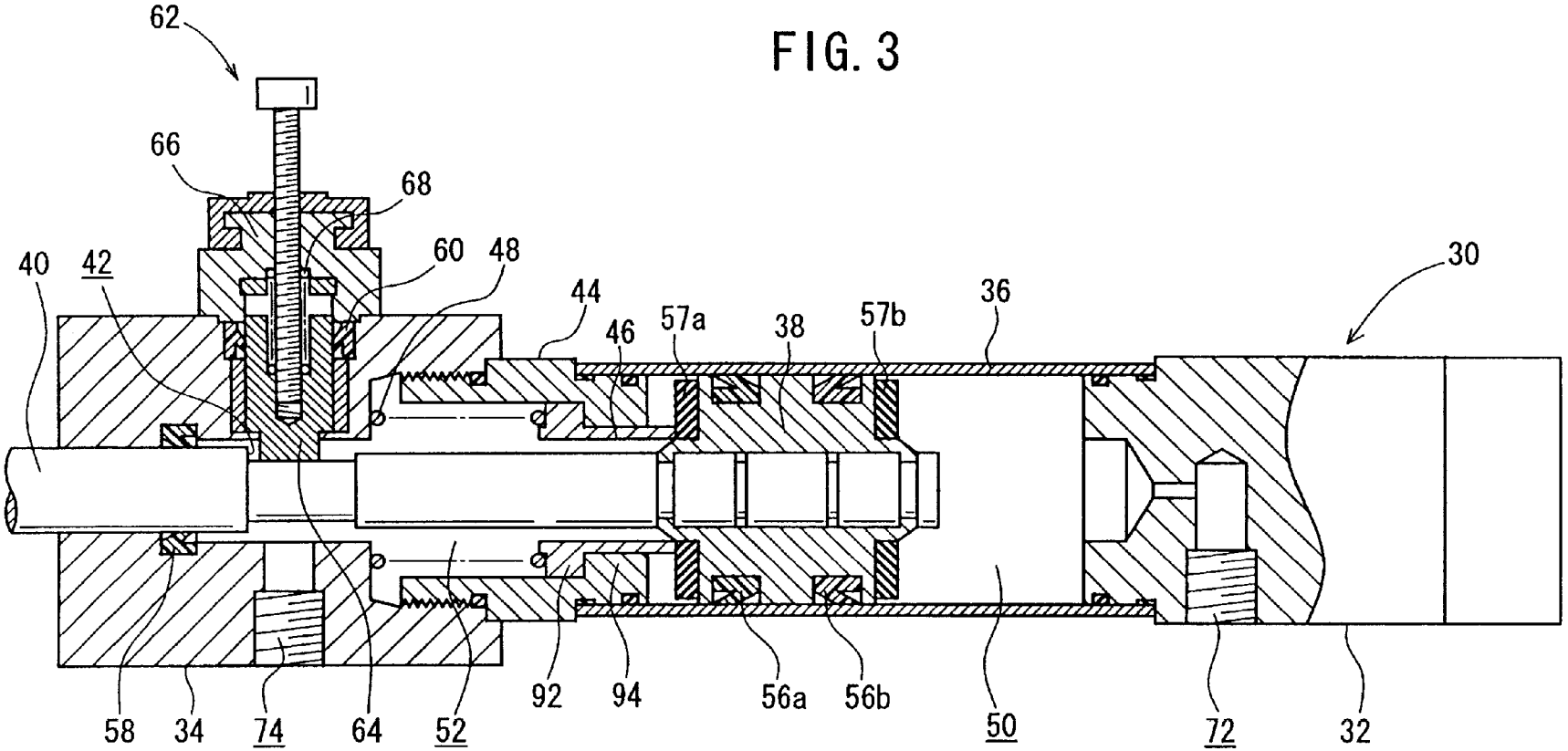
FIG. 3 is a longitudinal sectional view taken along the axial direction at an intermediate position of the piston of the cylinder apparatus according to the embodiment of the present invention.
Figure 9:
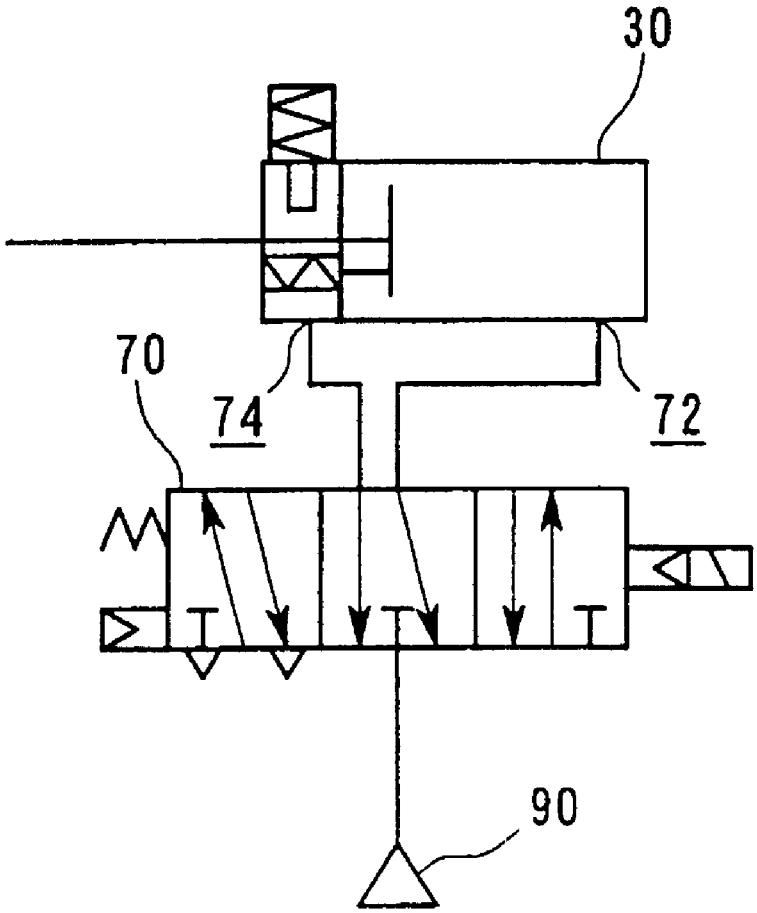
FIG. 9 is a diagram of circuit arrangement illustrating the intermediate position of the piston of the cylinder apparatus according to the present invention.

Next, as shown in FIG. 9, the pressure fluid supplied from the first pressure fluid inlet and outlet port 72 is released to the atmospheric air. Both of the first chamber 50 and the second chamber 52 become at the atmospheric pressure. The first spring member 48 interposed between the second cover member 34 and the movable member 46 expands to press the movable member 46 in the direction of the initial position. Accordingly, the piston 38 held against the end surface of the movable member 46 is pressed and displaced by a length (X1) in the axial direction of the third chamber 54, i.e., in the direction of the initial position. The piston 38 is thus in the intermediate position as shown in FIG. 3.

Figure 6:
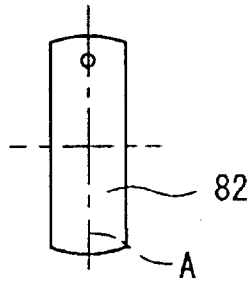
FIG. 6 is a plan view illustrating the operation of the key at the intermediate position of the piston of the cylinder apparatus according to the embodiment of the present invention.

At the intermediate position of the piston 38, the key 82 formed on the upper surface of the rotary member 88 is rotated in the direction of the initial position as shown in FIG. 6. The key 82 can be inserted into the key groove even if the key groove is displaced from the original position thereof due to the dimensional error of the workpiece.

The length (X1) in the axial direction of the third chamber 54 is arbitrarily changed to easily make it possible to adjust and handle the dimensional error of the workpiece even if the dimensional error thereof changes.

The length (X1) in the axial direction of the third chamber 54 defined between the intermediate member 44 and the movable member 46 at the displacement terminal end position is shorter than the distance (X2) between the side surface of the recess 42 of the piston rod 40 and the side surface of the pin 64. That is, the relationship $X1<X2$ is satisfied. Therefore, the recess 42 of the piston rod 40 and the pin 64 do not contact with each other at the intermediate position. When the pressure fluid is supplied in the second chamber 52, the pin 64 is moved upwardly while contracting the second spring member 68 and separates from the recess 42 of the piston rod 40 with ease.

Figure 7:
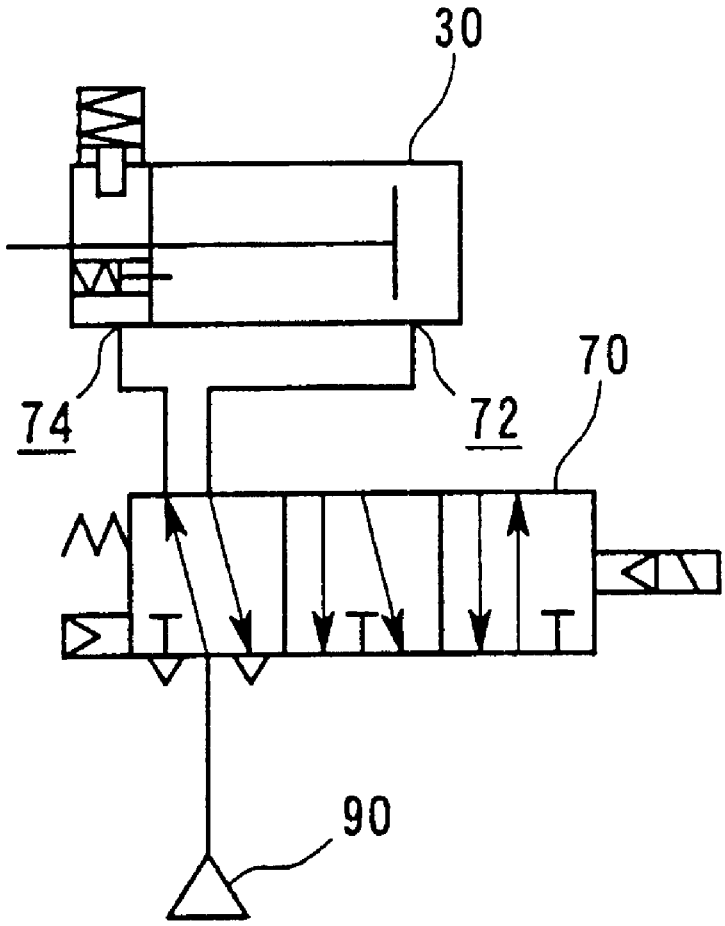
FIG. 7 is a diagram of circuit arrangement illustrating the initial position of the piston of the cylinder apparatus according to the present invention.

Next, as shown in FIG. 7, the pressure fluid is supplied from the pressure fluid supply source 90 via the five-port solenoid-operated valve 70 to the second pressure fluid inlet and outlet port 74. Then, the first pressure fluid inlet and outlet port 72 is being communicated with the atmospheric air.

The pressure fluid is supplied from the second pressure fluid inlet and outlet port 74 into the second chamber 52 in the cylinder tube 36. The pin 64 is pressed and moved upwardly while contracting the second spring member 68. The piston 38 is pressed in the direction of the first cover member 32 until it reaches the initial position.

When the piston 38 is pressed in the direction of the first cover member 32, the piston 38 is displaced up to the initial position again. The piston rod 40 connected integrally to the piston 38 is displaced at the same time. Accordingly, the key 82 formed on the upper surface of the rotary member 88 is substantially parallel to the axial direction of the cylinder apparatus 30 as shown in FIG. 4.

In the above embodiment of the present invention, the piston 38 pressed and returned from the displacement terminal end position to the intermediate position is displaced by the length (X1) in the axial direction of the third chamber 54, the third chamber 54 being defined between the intermediate member 44 and the movable member 46. Accordingly, it is possible to highly accurately position the intermediate position set between the initial position and the displacement terminal end position of the piston 38. Consequently, the key 82 can be preferably inserted into the key groove of the workpiece without the influence of the dimensional error of the workpiece.

If the piston 38 is located at the displacement terminal end position, the length (X1) in the axial direction of the third chamber 54 defined between the intermediate member 44 and the movable member 46 is shorter than the distance (X2) between the side surface of the recess 42 of the piston rod 40 and the side surface of the pin 64 of the piston pin mechanism 62. Accordingly, even if the piston 38 is displaced up to the intermediate position, the side surface of the recess 42 of the piston rod and the side surface of the pin 64 do not contact with each other. Therefore, the piston pin mechanism 62 can be easily unlocked.

One piece of the five-port solenoid-operated valve 70 may be used instead of two pieces of three-port solenoid-operated valves to decrease the number of components. The control circuit for the pressure fluid supplied to the cylinder apparatus 30 can also be simplified.

Figure 15:
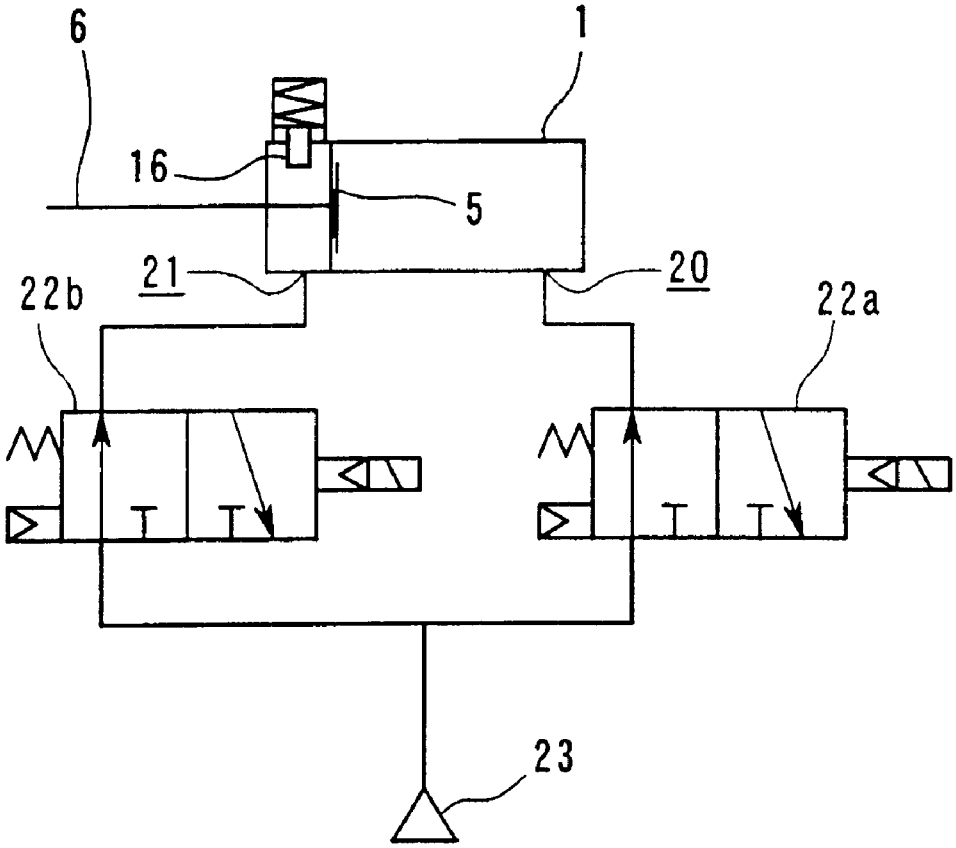
FIG. 15 is a diagram of circuit arrangement illustrating a step of unlocking a pin of a piston pin mechanism of the conventional cylinder apparatus.

Consequently, the production cost can be reduced. The step of simultaneously pressurizing the first pressure fluid inlet and outlet port 72 and the second pressure fluid inlet and outlet port 74 as shown in FIG. 15 can also be omitted, which would be otherwise performed to unlock the piston pin mechanism 62 from the recess 42 of the piston rod 40.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A cylinder apparatus comprising:

a cylinder tube which is integrally connected between a first cover member and a second cover member;

a piston which is installed in said cylinder tube and which is axially displaceable in said cylinder tube;

a piston rod which is connected to said piston;

an intermediate member which is connected between said cylinder tube and said first cover member or said second cover member;

an axially movable member which inscribes said intermediate member;

a spring member which is interposed between said first cover member or said second cover member and said movable member; and a fastening mechanism which includes a pin section for holding said piston by being inserted into a recess of said piston rod in a direction substantially perpendicular to the axis of said cylinder apparatus, wherein when said piston reaches a displacement terminal end position, an axial length of a space is shorter than an axial distance between a side surface of said recess of said piston rod and a side surface of said pin section of said fastening mechanism, said space being defined between said intermediate member and said movable member.

2. The cylinder apparatus according to claim 1, wherein said intermediate member has a first annular projection protruding radially inwardly, said movable member has a second annular projection protruding radially outwardly, and said space is formed between said first annular projection and said second annular projection.

3. The cylinder apparatus according to claim 2, wherein when said piston reaches said displacement terminal end position, said piston returned toward another displacement terminal end position is displaceable by said axial length of said space.

4. The cylinder apparatus according to claim 1, wherein said fastening mechanism is a piston pin mechanism, said piston pin mechanism including a main body section which is installed to an outer circumferential surface of said first cover member or said second cover member, a pin section which is supported by said main body section, and a second spring member which is interposed between said main body section and said pin section.

5. The cylinder apparatus according to claim 1, wherein a first pressure fluid inlet and outlet port and a second pressure fluid inlet and outlet port are formed in said first cover member and said second cover member respectively, a pressure fluid being supplied through a five-port solenoid-operated valve to said first pressure fluid inlet and outlet port or said second pressure fluid inlet and outlet port.

6. The cylinder apparatus according to claim 1, wherein said cylinder apparatus further comprises a driving force-transmitting mechanism, said driving force-transmitting mechanism including a joint member which is connected to said piston rod and which converts the rectilinear motion of said piston rod into the rotary motion, a rotary member which is rotatable about an axial center thereof, a key section which is formed on said rotary member and which is inserted into a key groove of a workpiece, and a link section which transmits said rotary motion of said joint member to said rotary member.

* * * * *